United States Patent [19]

Wollard

[11] 4,027,613

[45] June 7, 1977

[54] PLANING BOAT HULL

[76] Inventor: Donald L. Wollard, 105 Bayview Drive, Islamorada, Fla. 33036

[22] Filed: Dec. 10, 1975

[21] Appl. No.: 639,372

[52] U.S. Cl. ..... 114/291

[51] Int. Cl.[2] ..... B63B 1/18

[58] Field of Search ..... 114/66.5 R, 66.5 S, 114/56, 61, 66.5 P; 115/39, 41 R; 9/6

[56] References Cited

UNITED STATES PATENTS

| | | | |
|---|---|---|---|
| 3,091,206 | 5/1963 | Cale | 114/66.5 R |
| 3,382,833 | 5/1966 | Wukowitz | 114/66.5 S |
| 3,469,557 | 9/1969 | Wollard | 115/39 |
| 3,625,173 | 12/1971 | Mitton | 114/66.5 S |
| 3,744,446 | 7/1973 | Gibbins | 9/6 M |
| 3,745,963 | 7/1973 | Fisher | 114/66.5 P |
| 3,793,980 | 2/1974 | Sherman | 115/39 |

*Primary Examiner*—Trygve M. Blix
*Assistant Examiner*—Jesus D. Sotelo
*Attorney, Agent, or Firm*—Amster & Rothstein

[57] ABSTRACT

A novel bottom configuration for a V-type planing hull which consists of a V-shaped section which extends from the bow to a shoulder located aft of amidships, and a section aft of the shoulder consisting of a partial continuation of the V-sidewalls, joined by a generally horizontal bottom wall which extends to the transom.

9 Claims, 5 Drawing Figures

FIG. 1.
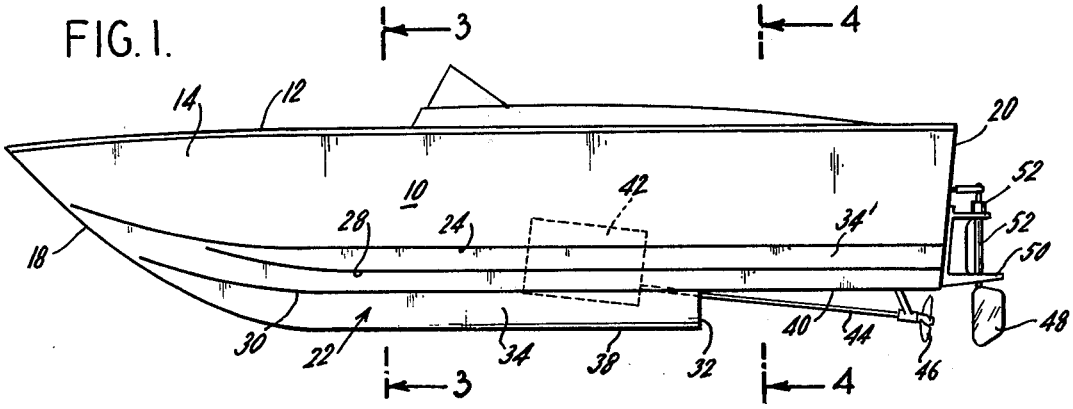
FIG. 2.
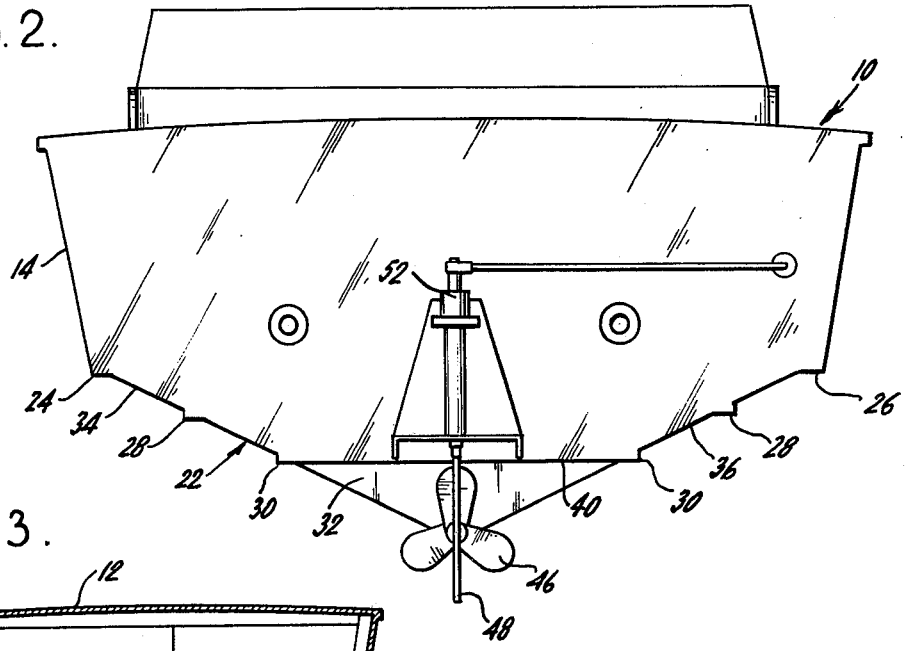
FIG. 3.
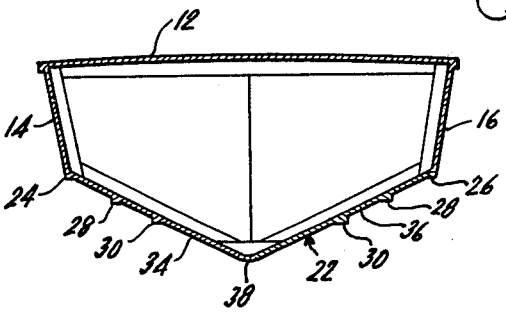
FIG. 4.
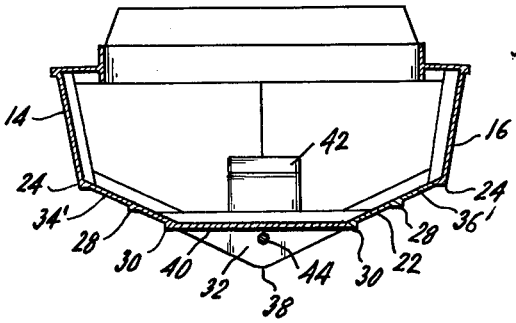
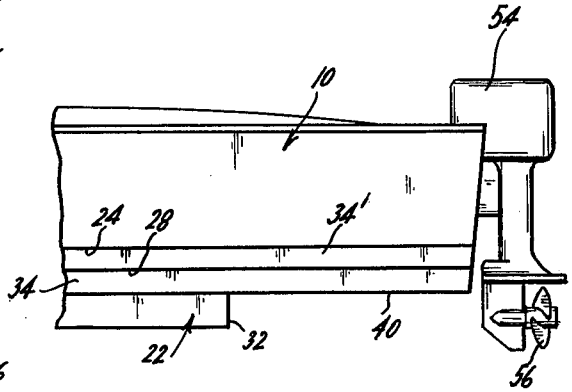
FIG. 5.

PLANING BOAT HULL

This invention relates to power boats, and more particularly, to a novel hull design for planing boats adapted for efficient high-speed shallow water operation.

In recent years, planing boats having a so-called deep-V hull configuration have been exceptionally popular due to their desirable riding and handling characteristics, particularly in rough water. It has been known for some time, however, that boats having this type of hull configuration also suffer from significant disadvantages. For example, deep-V hull configurations are not particularly amenable to the utilization of inboard or outboard power drives. The hull configuration makes it difficult to properly mount an inboard engine in such a fashion that the drive shaft angle to a propeller positioned below the keel of the hull is sufficiently small for efficient operation. On the other hand, conventional outboard power drives cannot normally be mounted on the transom of a deep-V hull so that the propeller extends below the keel line, unless a substantial portion of the upper part of the transom is cutaway. Yet, a high transom is a very desirable safety feature for sea-going, rough water boats.

A further disadvantage of known deep-V hull configurations is the substantial power input which is required in order to achieve planing speeds, due to the frictional resistance offered by the rather large wetted surface of the hull bottom. Attempts have been made to overcome this problem by the incorporation of one or more transverse steps in the hull bottom. See, for example, Yost U.S. Pat. No. 3,568,617. As noted in that patent, these step configurations have a number of off-setting disadvantages and, accordingly, have not been widely used.

It is the general object of this invention to provide a modified V-hull configuration which overcomes the foregoing problems and which is useful with any type of power drive system, to provide a planing boat which is capable of efficient operation under a wide variety of conditions.

The objects of the invention are accomplished by a hull configuration characterized by a bottom having a V-shaped section which extends from the bow of the hull, to a vertical shoulder located aft of amidships and a truncated V-section; i.e., V-sided, generally horizontal bottom section, which extends aft of the shoulder to the transom at the stern of the hull. The invention will be further understood by reference to the following description and accompanying drawings, in which:

FIG. 1 is a side elevational view of a boat constructed in accordance with the present invention equipped with an inboard power drive system;

FIG. 2 is a rear elevational view of the boat of FIG. 1;

FIG. 3 is a cross-sectional view of the boat of FIGS. 1 and 2, taken along the line 3—3 of FIG. 1;

FIG. 4 is a cross-sectional view of the boat of FIGS. 1 and 2 taken along the line 4—4 of FIG. 1; and FIG. 5 is a partial side elevational view of a boat having a hull configuration similar to that shown in FIG. 1 but equipped with an outboard power drive unit.

Referring in detail to the drawings, FIGS. 1 and 2 illustrate a typical power boat constructed in accordance with the present invention which comprises a hull 10, having a top deck 12; generally vertical top sidewalls 14 and 16, which extend from a bow 18 to the transom or stern 20 of the hull; and a bottom 22, which is joined to the top sidewalls of the hull at the chines 24 and 26 which are the points of juncture of the hull bottom with the hull top sidewalls.

Although, as illustrated in FIG. 1, the top sidewalls 14 and 16 curve longitudinally inward to form a sharp V-shaped bow 18, the shape of the bow is not critical to the invention, which resides in the configuration of the hull bottom. Moreover, the longitudinal stringers, or strakes 28, 30, which are an integral part of the hull bottom illustrated in the drawings, are not critical to the invention but are conventionally employed to strengthen the hull, hold down spray and add stability in accordance with known practices in the art.

With respect to the hull bottom, as best seen in FIGS. 1 and 3, the portion of the hull bottom commencing at the bow 18 and extending aft to shoulder 32 is a conventional V-bottom consisting of straight-sided bottom walls 34 and 36 which join together and terminate in keel 38. As best seen in FIGS. 2 and 4, the hull bottom aft of the shoulder 32 and continuing to the transom 20 consists of a partial continuation of bottom sidewalls 34 and 36 (designated 34′ and 36′ in FIG. 4) and a bottom wall 40 which joins continuing bottom sidewalls 34′ and 36′. As best seen in FIGS. 2 and 4, the shoulder 32 extends across the bottom and defines the starting point of bottom wall 40.

The depth and location of shoulder 32 are not critical and may vary for optimum performance, depending upon such factors as the length of the boat, the depth of the V-angle of the bottom sidewalls of the hull, i.e., the angle which the bottom sidewalls form with an imaginary extension of keel 38 aft to the transom, the type of power drive and the size of the propeller. Ordinarily, the shoulder will be located aft of amidships; i.e., the longitudinal center of the boat, so that the length of bottom wall 40 will be approximately 10 to 50%, preferably 33% of the overall length of the boat. The vertical extent of shoulder 32; i.e., the vertical distance between keel 38 and bottom wall 40, will normally be selected so that the width of wall 40 will be 20 to 80%, preferably 40% of the distance between chines 24 and 26. Accordingly, the vertical extent of the shoulder may range from 1 to 30 inches. The angle of V is likewise not critical and may vary, for example, from 5° to 35°. Deeper V-hulls; i.e., hulls having a V-angle of 20° or more, e.g., 30°, are preferred since they maximize the advantages of the novel hull bottom configuration.

Although bottom wall 40 is illustrated as a substantially horizontal, or flat surface, it will be apparent to those persons skilled in the art that it is not intended to be limited to a flat surface but may be any desired shape, for example, an inverted V-surface; a longitudinally or transversely concave or convex surface; or an irregularly shaped surface formed by varying the vertical extent of shoulder 32. The latter shape is particularly useful to accommodate multiple propellers.

In one preferred embodiment, the hull bottom configuration is applied to a boat hull having an overall length of 23 feet 7 inches and a width of 8 feet, in which the distance between the chines is approximately 7 feet 10 inches. In that boat, the vertical extent of the shoulder 32 measured at the keel is 8 to 12 inches deep, depending on the size of the propeller, the distance from the shoulder 32 to the transom 20 is approximately 5 feet, and the transverse bottom wall 40 has a width of about 5 feet.

Although in side elevation, as illustrated in FIG. 1, the shoulder 32 gives the appearance of a step, it will be appreciated by those persons skilled in the art that the so-called steps of prior art hydroplanes extend from chine-to-chine and the general cross-sectional shape of the hull bottom aft of a typical prior art step is the same as the shape forward of the step. While not wishing to be limited to any particular theory of operation, it is presently believed that it is the combination of the continuous chines 24, 26 and upper portion of the bottom sidewalls 34', 36', coupled with the abrupt change in the cross-sectional configuration of the hull bottom aft of the shoulder 32, and more particularly the presence of a generally transverse bottom wall 40, which are responsible for the advantages of the invention. More particularly, in operation at planing speeds, boats having the novel hull bottom configuration of the invention will exhibit a tendency to plane on the V-shaped keel 38 forward of shoulder 32, rather than further aft toward the transom 20 as in a conventional V-bottom hull. As a result, there is a reduction of wetted surface area aft of shoulder 32 in the area of bottomwall 40 and, accordingly, the frictional forces acting on the hull are lower, thereby increasing the lift for a given power input. In addition, it is believed that the water coming off the keel 38 at shoulder 32 rises upward and impinges on bottom wall 40, thereby developing additional lift which prevents dragging or squatting at the stern. The novel hull bottom configuration also produces a smooth, stable ride, since there is no disruption of the chines or associated bottom sidewall surfaces of the hull which, together, appear to act as elongated trim tabs which extend aft of the shoulder 32 to the transom 20.

It will be apparent from FIGS. 1 and 5 that a substantial additional benefit of the novel hull bottom configuration of the invention is the ability to obtain shallower draft operation, irrespective of whether inboard, inboard/outboard, or outboard power drive systems are utilized. Referring specifically to FIGS. 1 and 2, an inboard power drive system is illustrated in combination with the novel hull bottom configuration. More specifically, these drawings show an inboard engine 42 and a propeller drive shaft 44, on which a propeller 46 is mounted. It is apparent from FIG. 2 that the axis of rotation of propeller 46 is substantially aligned with the keel 38, so that a substantial portion of the propeller (approximately one-half of the propeller in FIG. 2) is located above the bottom of the boat. This arrangement not only permits shallower draft operation with higher propeller safety but also results in more efficient utilization of the inboard power plant as a result of the shallower drive shaft angle, which results from mounting the propeller in a higher location than would be possible with a conventional V-hull configuration. However, the hull configuration offers substantial advantages, irrespective of the location of the propeller, which may be located above or below the keel, and can be utilized with any drive system including, for example, a jet drive. It will also be apparent that the hull configuration can be employed in boats intended for use with two or more engines and propellers.

FIG. 5 illustrates the novel hull configuration of the invention in combination with an outboard power drive unit 54. As with the inboard embodiment, the propeller 56 of the outboard unit may be located so that a substantial portion of the propeller rotates above the keel 38. This arrangement enables shallower draft operation, as compared to conventional V-hulls in which the propeller must rotate below the keel. In addition, because outboard power units are manufactured in standard lengths, the outboard power unit may be mounted substantially higher on the transom than in conventional V-hull configurations, thereby permitting a higher than normal transom for added safety in rough seas, in addition to maximizing the distance between the motor and the water so as to minimize the danger of drowning out the motor.

Boats embodying the invention will also incorporate suitable steering systems, including a rudder 48 and appropriate steering linkages 52 such as are illustrated in FIG. 1. Rudder 48 may also be located forward of the transom or at the transom. When the rudder is located behind the transom, it may also include a cavitation plate 50. It is a further feature of the invention to locate such a cavitation plate so that it acts as a rearward continuation of bottom wall 40 aft of the transom, so as to guide the flow of water to provide additional flow control and balance for varying wave and load conditions. The plate, which may extend across the entire width of bottom wall 40, may be employed for this purpose even when rudder 48 is located forward of the transom.

Having described the general nature, as well as specific embodiments of the invention, the scope of the invention will be apparent from the claims.

What is claimed is:

1. In a planing boat, a hull including a bow, a transom, top sidewalls and a bottom extending from said bow to said transom, said bottom including a V-shaped forward bottom section extending from said bow to aft of amidships, said V-shaped forward bottom section including a pair of bottom sidewalls which join at a keel, a vertically extending shoulder extending across the bottom and joining said bottom sidewalls and defining the rearmost end of said V-shaped bottom section and a rearward bottom section including a transverse wall extending from said shoulder to said transom and a continuation of the upper portion of said bottom sidewalls joined to said transverse wall and extending upwardly and outwardly therefrom.

2. The planing boat of claim 1, further including power means, said power means including at least one propeller, said propeller being positioned such that at least a portion of said propeller is above said keel.

3. The planing boat of claim 2, wherein the axis of rotation of said propeller is substantially in alignment with said keel.

4. The planing boat of claim 2, wherein said propeller is located forward of the transom.

5. The planing boat of claim 2, wherein said propeller is located aft of the transom.

6. The planing boat of claim 1, wherein said rearward bottom section constitutes 10 to 50% of the overall length of said boat.

7. The planing boat of claim 1, wherein the vertical extent of said vertically-extending shoulder is from 1 to 30 inches.

8. The planing boat of claim 1, further including chines defining the point of juncture between said bottom sidewalls and said top sidewalls.

9. The planing boat of claim 1, further including a rearward continuation of the rearward bottom section aft of said transom.

* * * * *